US006145134A

United States Patent [19]

Davis et al.

[11] Patent Number: 6,145,134

[45] Date of Patent: Nov. 14, 2000

[54] CUSTOM FITTED BODY PART PROTECTOR AND METHOD

[75] Inventors: James B. Davis, Martinez; Arlene L. Odom, Evans, both of Ga.

[73] Assignee: Sports Performance Products, Augusta, Ga.

[21] Appl. No.: 09/273,553

[22] Filed: Mar. 22, 1999

[51] Int. Cl.[7] ..... A41D 13/00

[52] U.S. Cl. ..... 2/463; 2/465; 2/467; 2/247; 2/44; 602/6; 602/20

[58] Field of Search ..... 2/463–465, 455, 2/456, 908, 467, 247, 44, 45, 267, 268; 128/878, 879; 602/6–8, 19, 20, 21, 64

[56] References Cited

U.S. PATENT DOCUMENTS

| | | | |
|---|---|---|---|
| 4,353,133 | 10/1982 | Williams | 2/45 |
| 4,373,211 | 2/1983 | Goudreau et al. | 2/2 |
| 5,732,713 | 3/1998 | Duback et al. | 128/846 |
| 5,733,249 | 3/1998 | Katzin et al. | 602/21 |
| 5,742,947 | 4/1998 | Davis | 2/463 |
| 5,957,871 | 9/1999 | Darcey | 602/12 |
| 5,972,039 | 10/1999 | Kristinsson et al. | 623/33 |

*Primary Examiner*—John J. Calvert
*Assistant Examiner*—Tejash Patel
*Attorney, Agent, or Firm*—Aquilino, Welsh & Flaxman

[57] ABSTRACT

A body protector for being custom fitted to a body part to be protected formed of a flexible garment member shaped to lie over the body part to be protected. The garment member is made with two spaced, inner and outer sheets of material forming an inner pocket between the layers. An opening for access into the pocket is formed along at least one of said edges and includes a closure fastener for opening and closing the opening. An insert made with a moisture curable, resin impregnated material is shaped to fit into and dimensionally conform to the pocket to provide a rigid barrier for the body part when the resin is hardened. Straps are provided to secure the protector to the user.

11 Claims, 4 Drawing Sheets

CUSTOM FITTED BODY PART PROTECTOR AND METHOD

BACKGROUND AND SUMMARY OF THE INVENTION

The present invention relates to body part protectors and in particular to a custom fitted chest protector to protect a user when playing sports and similar activities.

Organized sports has become quite common place for youth. Games and leagues are organized for playing all types of sports including soccer, football, basketball and baseball, among others. All of these sports can be hazardous for youth. A particularly hazardous game is the game of baseball when a ball is being pitched at a batter. Being hit in the head by a pitch or batted ball may result in a severe injury, however another lesser known but fairly common injury is a batter being hit in the chest causing blunt chest trauma. This type of injury occasionally can be lethal if cardiac concussion occurs, resulting in the death of a young player. A known solution to prevent these types of injuries is to wear protective vests. U.S. Pat. No. 5,742,947 to Davis, a co-inventor of the present invention, recognizes this problem and provides an adjustable chest protector specifically designed to prevent these types of athletic injuries. The chest protector is C-shaped and designed to fit comfortably and unnoticeably underneath the clothing of the user while allowing free, unhindered movement. The adjustable chest protector is contoured to assume the natural shape of the user's hemithorax. This protector was specifically designed to worn under the uniform of the athlete in order to provide a level of protection from injury while being esthetically pleasing and conforming with league rules relating to specific uniforms.

One difficulty in providing chest protectors for useful athlete wear is the wide variety of sizes of bodies of the athletes playing the game. This makes it difficult, if not impossible, to provide universally fitting protectors to adequately protect the athlete from injury. Custom fitting body protective pads has been recognized in the prior art, for example, U.S. Pat. Nos. 5,454,780, 5,456,658, 5,480,376 and 5,544,663 to Parker Medical Associates are directed to custom fitted protective pads, specifically shin guards, using moisture curable resin to form a rigid structure conforming to the shape of the shin body part to be protected.

Prior art devices of this type are made with curable resin which hardens when exposed to moisture. A shortcoming of the prior art is the premature hardening of the product inside an unopened pouch or packaging container in which it is sold. The materials used to construct the device, such as the thread used for surging the edges, along with the fabric, separable fastener material, and elastic, contain a certain percentage of moisture even when the item is sealed within an airtight pouch. This moisture, which may be as little as 0.01%, causes premature hardening of the product, often in as little as weeks or a few months. Typically more and more of the product hardens as shelf life increases, making it impossible to mold the product to the user's body after it is taken from the packaging pouch. Another shortcoming is that the product cannot be fitted prior to opening the pouch since moisture in the air will harden the product. Therefore if the size is incorrect, the product cannot be used and must be discarded. A still further shortcoming is that the prior art requires exposure to the hardening chemicals as the product is fitted and molded to the user.

The present invention is directed to an improved custom fitted chest protector for prevention of chest related injuries, specifically during playing the game of baseball. The protector covers the chest area of the athlete and is designed to be worn underneath a conventional uniform shirt and therefore is not readily noticeable by others. The protector is shaped to be worn adjacent the arm and extending upwardly to cover the chest area including at least a forward portion of the thorax, ribs and torso, near the pectoralis muscle and also posteriorly to cover the areas of the scapula and upper back muscles. This protector structure covers the part of the upper body which would normally face the pitcher when the athlete assumes a normal batting stance. For example, a right handed hitting athlete would use a customized chest protector designed to protect primarily the upper left portions of the upper body.

The protector of the present invention preferably is made in two parts including a jacket like garment having a pocket and a moldable insert designed and shaped to fit into the pocket in the jacket garment and conform with the physical body characteristics of the particular athlete. Preferably the insert is made of a fiberglass, foam or felt material with a polyethelene foam cover, impregnated with a moisture curable resin, such as polyisocyanate, in a sealed pouch. The jacket is sewn together with at least two layers of fabric or other similar material. An opening is provided along a length of seam, preferably along a bottom edge of the garment, having a separable fastener closure to seal the opening. The garment may be worn to insure the size is correct before the insert is activated by opening the airtight pouch and exposing the curable resin to air.

Since the protector comes in two parts, it requires assembly, by the consumer, to obtain a custom fit. Once it is determined that the protector is the right size by trying on the jacket type garment, the insert piece, which is stored in the sealed, airtight pouch, is removed from the air tight pouch, placed in the garment opening and fitted against the body of the user to obtain an exact contoured fit. Since the impregnated material is covered by the polyethelene cover, the resin material does not contact the athlete and/or anyone assisting in the fitting process.

Among the objects of the present invention is the provision of a chest and/or rib protector which is custom fitted to the upper torso of an athlete.

Another object of the present invention is to provide a protector that is comfortable and provides free movement to the athlete during the playing of a game.

Still another object of the present invention is to provide a protector which provides personal security to the athlete thus enabling him to focus on playing the game rather than a fear of injury.

A still further object of the present invention is the provision of a protector which may be easily custom fitted to an individual athlete without subjecting the user to adverse effects of curing materials and/or chemicals.

Another object is to provide protection to individuals having injuries to the torso such as broken ribs, injured kidneys or individuals wearing implanted pacemakers.

Another object is the provision of a protector which permits removal of the hardened insert from the jacket for replacement with a new moldable insert should the athlete change in size.

Another object is the provision of a jacket which can be tried on for sizing before the insert in the foil pouch is opened.

Other objects, advantages and salient features of the invention will become apparent from the following detailed description, which taken in conjunction with the annexed drawings, discloses a preferred, but not limiting, embodiment of the subject invention.

DESCRIPTION OF THE PREFERRED EMBODIMENTS

Figure 1:
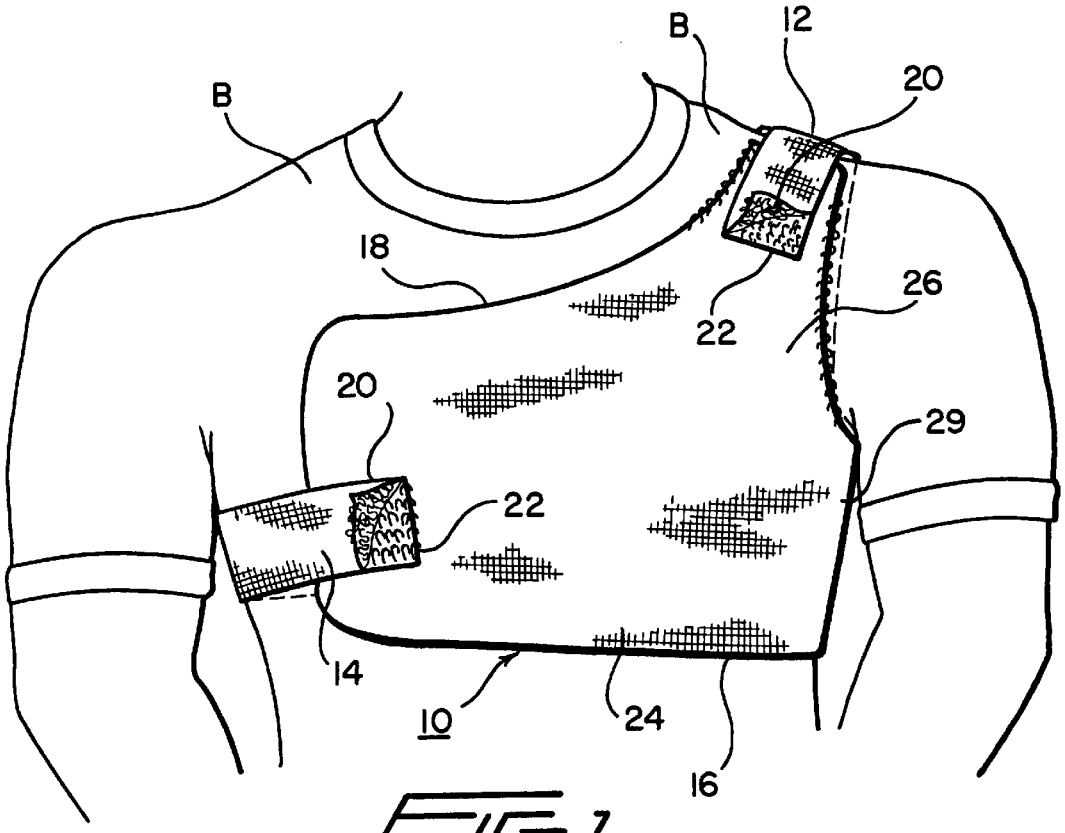
FIG. 1 is a diagrammatic view of the front of the protector of the present invention on the upper torso of a wearer.
Figure 2:
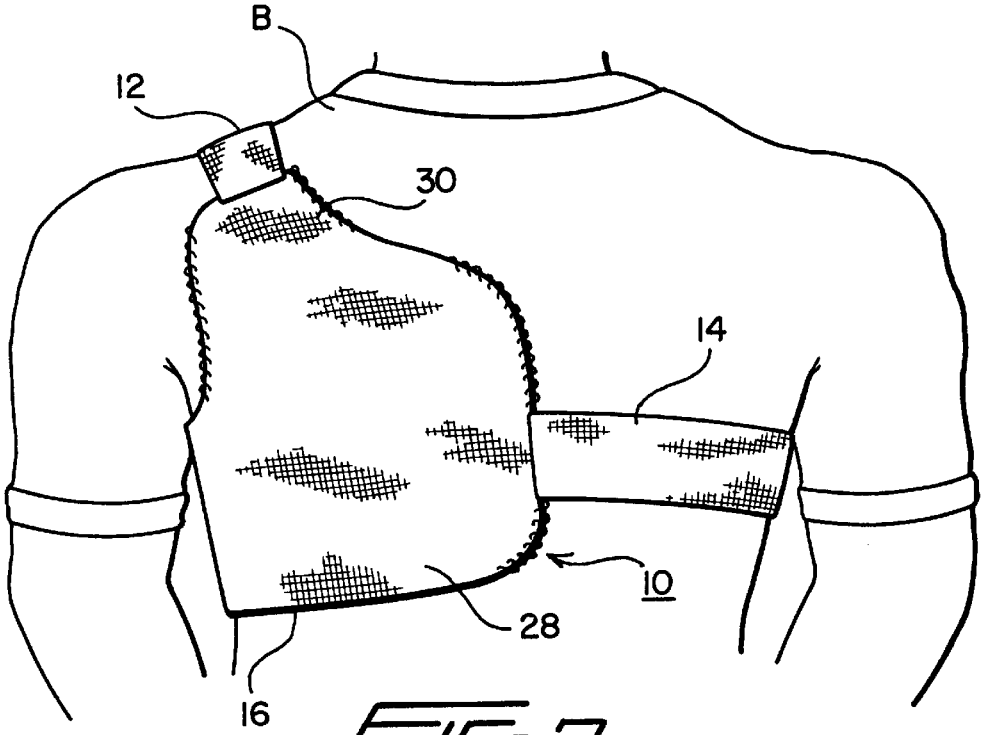
FIG. 2 is a diagrammatic view of the rear of the protector on the upper torso of a wearer.
Figure 4:
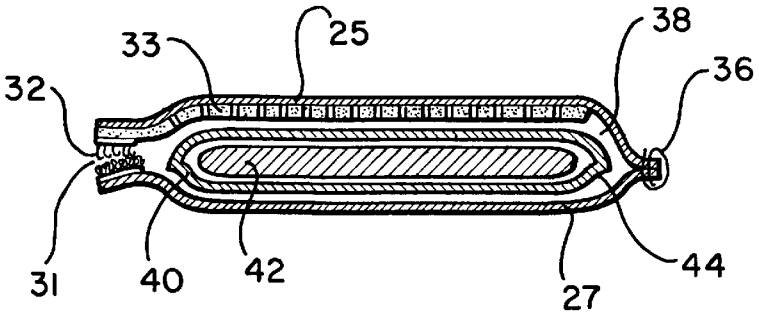
FIG. 4 is a sectional view taken along the line 4—4 of FIG. 3.

FIGS. 1 and 2 illustrate a protector 10 being worn on the upper torso of a baseball player. The protector 10 is contoured to fit the body B of the athlete adjacent the arm and extend upwardly to cover a forward portion of the chest area which would normally face a pitcher, including the thorax, ribs and torso, near the pectoralis muscle and also posteriorly to cover the areas of the scapula and upper back muscles. The protector 10 includes a pair of straps 12 and 14. Strap 12 is designed to be placed over the leading shoulder. Strap 14 is connected under the trailing shoulder.

The straps 12 and 14 include at least a partial elasticized section. The ends of each strap 12 and 14 are provided with a loop type material 20 which co-operates with a pair of hook type fastener pads 22 located on the protector 10.

Figure 3:
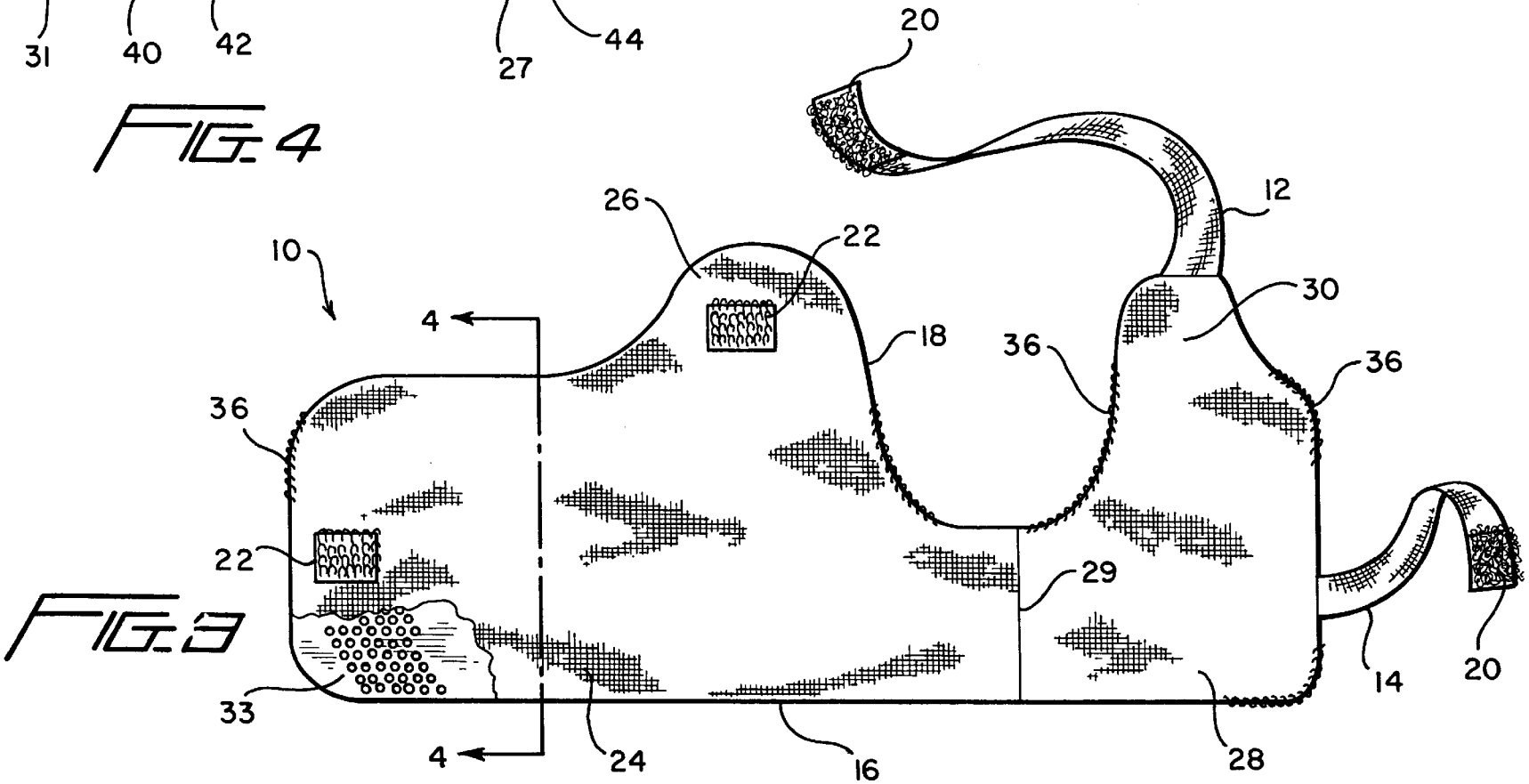
FIG. 3 is a plan view of the outer side of the protector of the present invention.

As best illustrated in FIG. 3, the protector 10 shown laid flat, is a shaped garment like structure having a generally straight lower edge 16 and a contoured upper edge 18. A large frontal section 24 of the protector 10 is placed on the leading portion of the body B, that is, the portion of the users body which faces the source of potential injury, for example, a thrown or pitched baseball. This section 24 includes a raised portion 26 extending upwardly to the shoulder to protect the pectoral muscle of the athlete. A smaller rear section 28 of the protector 10 is worn on the back of the athlete and also includes an upper rear portion 30 which covers the scapula and the associated back muscles. Preferably, the garment is made in one piece with stitch lines 29 positioned to create a defined area of bending. Also, it is contemplated that the large front section 24 and the smaller rear section 28 can be made in two pieces and stitched together along stitch line 29. Both the front section 24 and rear section 28 of the protector 10 are made with an inner sheet of fabric 25 which lies against the body of the athlete, and an outer sheet of fabric 27 sewn by stitches 36 along the peripheral edges of the protector 10, preferably with a binding (not shown). The lower edge 16 of each section of the protector 10 is formed with an opening 31 between the inner and outer layers having a hook and loop separable fastener 32 enabling the opening 31 to be opened and securely closed. Inner sheet of fabric 25 may be formed with an additional layer of vented, foam cushion material 33 to further protect the body of the athlete. The space between the inner and outer fabric forms a pocket 38. The protector 10 is designed to accommodate an insert 40 within the pocket 38, which is maintained therein by securing the separable closure fastener 32. It will be appreciated that the bottom of the rear section 28 also includes a similar opening and pocket for another insert protecting the back of the athlete.

Figures 5, 6:
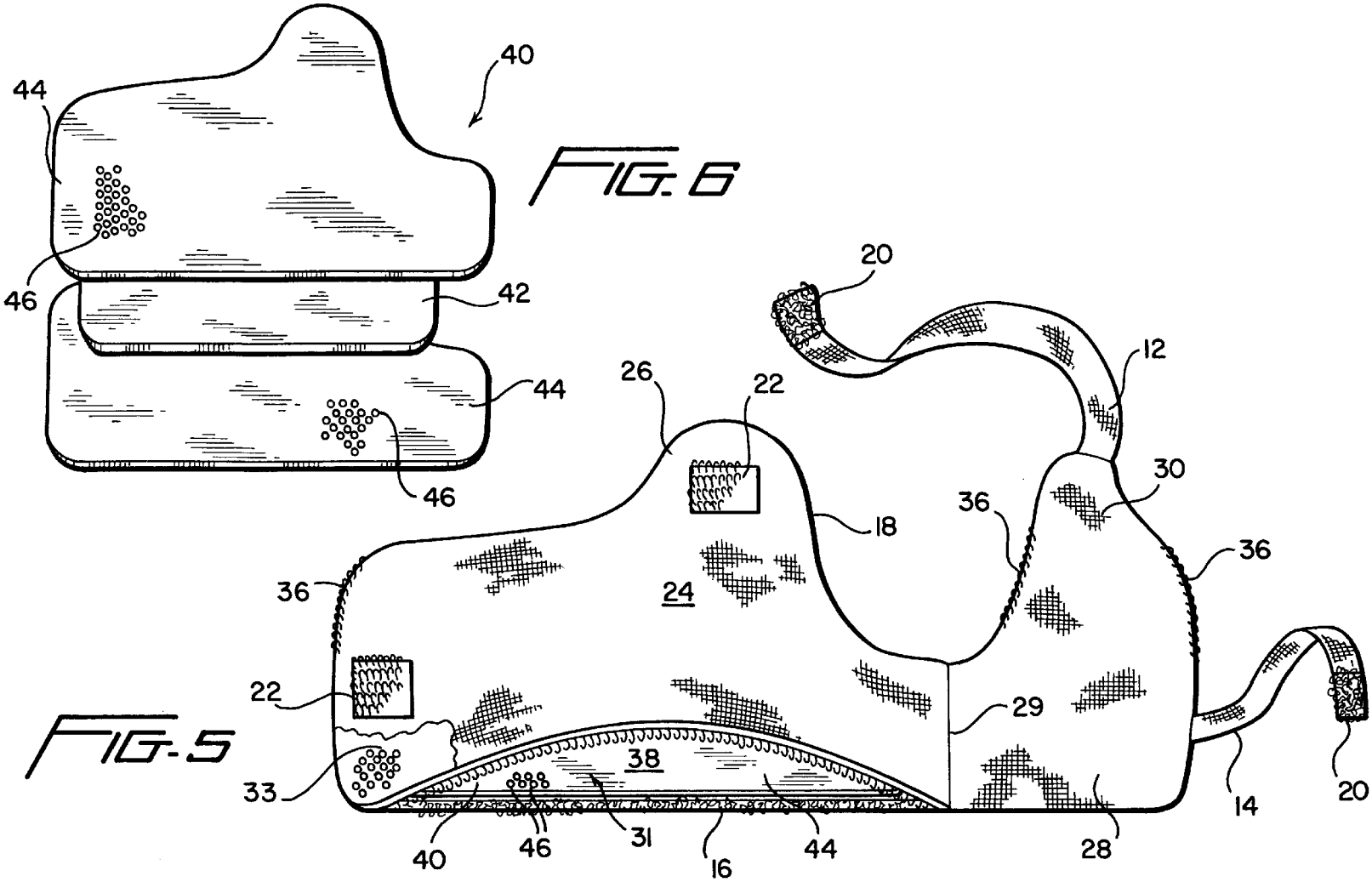
FIG. 5 is a view of the protector showing an interior pocket.
FIG. 6 is an exploded diagrammatic view of an insert used with the present invention.

The insert 40, shown in FIG. 6, is shaped to conform to the overall shape of the front section 24 of the protector 10. The insert 40 includes an inner core 42 which may be a solid piece of material or a plurality of sheets of material. The core 42 is impregnated with a moisture curable resin such as polyisocyanate. Inner core sheets of material may be fabric, fiberglass, foam, felt or any other materials capable of absorbing the moisture curable resin. The inner core 42 is covered with an outer sheath or cover 44 preferably made of a foam material such as polyethylene having a series of perforations 46 which allow moisture into the impregnated inner core 42 during the curing process. Thus in the present embodiment, the insert 40 has a straight bottom and a contoured top. The insert 40 may be formed as a single unit or be made as a plurality of insert pieces to facilitate insertion into the protector 10. Because the resin impregnated inner core material is encased in a polyethylene foam cover, the resin never touches the fingers or hands of the user as it is being fitted to the athlete.

It would be appreciated that the protector 10 may be made in a variety of sizes depending upon on the size of the individual athlete. Once a protector 10 is selected which is sized to fit the individual athlete, the airtight insert pouch is opened and the moisture activated resin impregnated insert 40 is removed. The insert 40 is wetted, for example by placing it under running water or dipping it in a bucket of water. Excess water may be removed, by placing the insert on a towel to wick away the free water. The insert 40 is then immediately placed within the pocket 38 formed in the protector 10 and the closure fastener 32 is closed. The protector 10 is then placed upon the athlete's upper body and it is manually shaped to conform with the specific contours of the body structure. The protector 10 and insert 40 are maintained on the athlete's body for at least 20 minutes until the resin hardens, preferably by wrapping the protector 10 while it is being worn with a gauze or similar cloth wrapping to insure the protector 10 stays in place. After the resin hardens, the protector 10 may be removed and stored for future use when playing a game.

Figure 8:
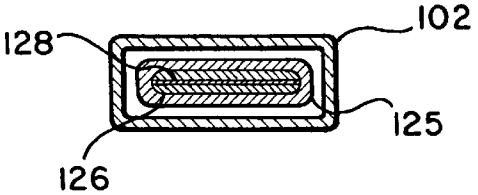
FIG. 8 is a sectional view taken along the line 8—8 of FIG. 7.
Figure 7:
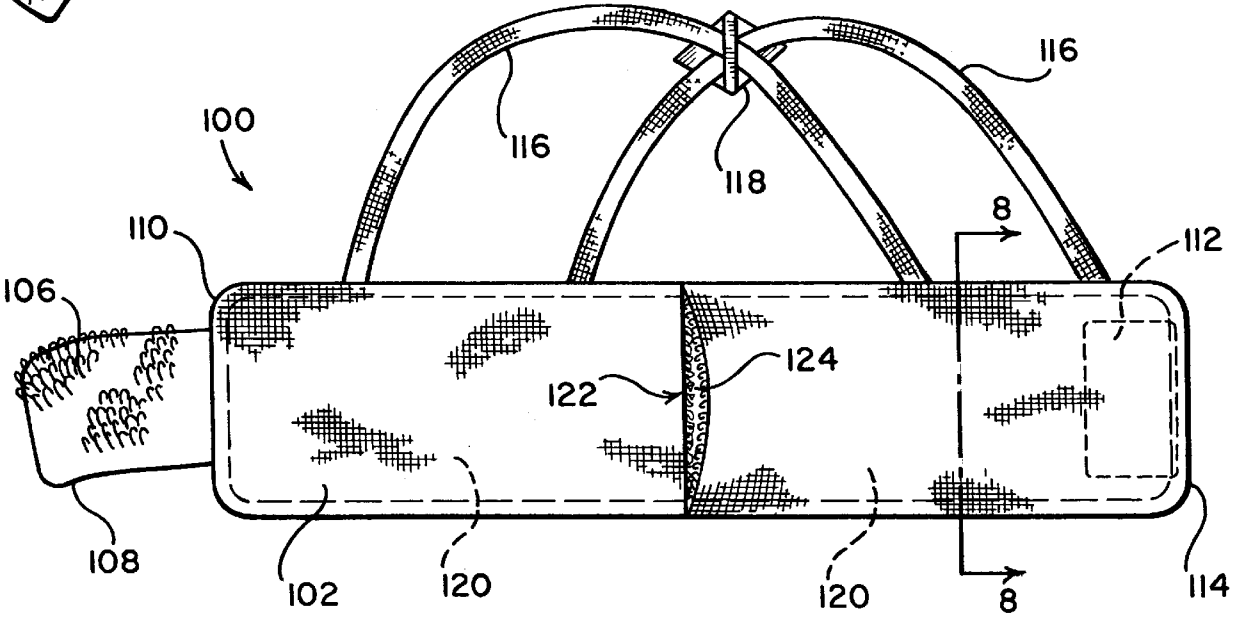
FIG. 7 is a diagrammatic view of a second embodiment in accordance with the present invention.

FIGS. 7 and 8 show a second embodiment of a protector 100 in accordance with the present invention designed to be worn around the waist of a user to protect the lower back and kidney areas. The protector 100 includes a wide belt 102, rectangular in shape, and having a separable fastener closure 104 for securing the belt around the waist of a user. The separable fastener closure 104 includes a hook type fastener element 106 forming a strap 108 connected to a first end 110 of the belt 104 and a loop type fastener pad 112 connected to an opposite end 114 of the belt 104. The protector 100 includes straps 116 connected to the top of the belt 104 which are structured to crisscross the back and shoulders of the user using a strap fastener 118 to support the protector 100 in position. The protector 100 includes a pair of pockets 120, shown in phantom lines, formed by front and rear layers of the protector 100. An opening 122 having another hook and loop separable fastener closure 124, is used to access the pockets 120 from the rear of the protector 100. Elongated inserts 125, which are generally rectangular in shape, are sized to fit within the pockets. The inserts 125 are made of the same material as described hereinabove with respect to the embodiment of FIG. 1, including an inner core 126 impregnated with moisture curable resin and a cover 128 totally surrounding the inner core 126. It will be appreciated that the inserts 120 are hardened by wetting in the same manner as described above and molded to the body of a user to provide a custom fit protection.

Figure 9:
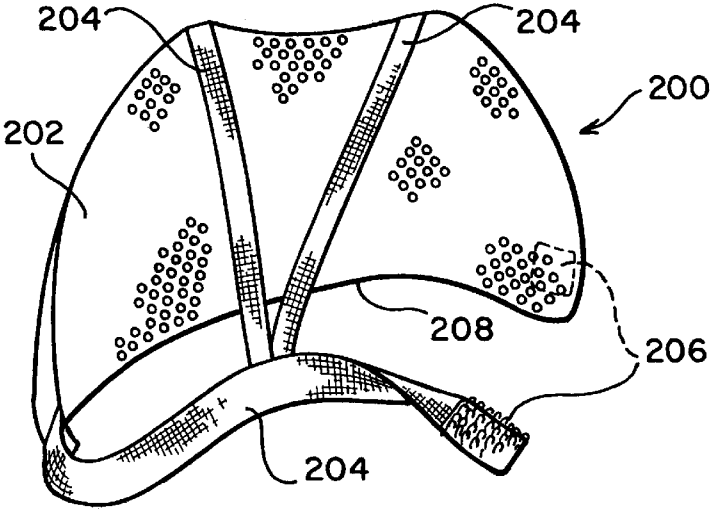
FIG. 9 is a diagrammatic view of a third embodiment in accordance with the present invention.

A third embodiment of a protector 200 is shown in FIG. 9. This protector 200 includes a chest shield 202, which is shaped to cover the entire frontal chest area of a user. Straps 204 are connected to the chest shield 202 and lie across the shoulders and waist of the user to support the protector 200 in place when it is worn. A suitable separable fastener 206 or other similar closures is used with the straps 204 to secure the protector 200 on the chest of a user. The chest shield 202 has an opening along its bottom edge. As with the previous embodiments, a single or multiple inserts (not shown) are placed into a pocket formed in the protector 200 through the opening formed along the bottom edge 208.

It will be appreciated that many variations may be made in the above described invention. For example the application has been shown and described as a chest protector but the protector may be made in a variety of sizes and shapes, such as a rib protector, arm or leg protector. Any other body part that needs to be protected may use a protector in accordance with the present invention. Thus the above description and the described embodiments are not intended to limit the scope of the invention rather it's intended to cover all modifications and alternate constructions falling within the spirit and scope of the invention as defined in the following claims.

What is claimed is:

1. In combination; a two part body protector custom fitted to the upper torso of a user, comprising:

an upper torso garment member defining a first part of said two part body protector; said garment member contoured to fit the upper torso of a user in a direction toward a potential source of injury, having a first section covering at least a forward frontal portion of the user's chest area, including the upper thorax, ribs, and pectoralis muscle and a second section covering a posterior portion of the user's upper torso including the scapula and upper back muscles; a first strap connecting said first and second sections across a leading shoulder facing said direction toward a potential source of injury; a second strap connecting said first and second sections under an opposite shoulder away from said direction toward a potential source of injury; said garment member having at least an inner sheet of material and an outer sheet of material connected thereto and forming a pocket therebetween; an opening between said inner sheet of material and said outer sheet of material, said opening providing access to said pocket; a closure fastener for opening and closing said opening; and a rigid insert defining a second part of said two part protector; said insert shaped to fit into and dimensionally conform to said pocket to provide a rigid barrier for the upper torso of the user.

2. The two part body protector of claim 1 further including a sheet of cushion material adjacent said inner sheet of material.

3. The two part body protector of claim 2 wherein said sheet of cushion material includes perforation openings.

4. The two part body protector of claim 1 wherein said opening is located along a lower edge of said upper torso garment member.

5. The two part body protector of claim 1 wherein said rigid insert is further defined as including an inner core impregnated with a moisture curable resin.

6. The two part body protector of claim 5 wherein said rigid insert further includes an outer sheath of foam fabric covering said inner core.

7. The two part body protector of claim 5 wherein said inner core is fabric.

8. The two part body protector of claim 5 wherein said inner core is foam.

9. The two part body protector of claim 5 wherein said inner core is felt.

10. The two part body protector of claim 1 wherein said first section is further defined as having a contoured upper edge defining a raised portion extending upwardly to the user's shoulder when worn on the user's torso.

11. The protector of claim 1 wherein said closure fastener is a hook and loop type separable fastener.

* * * * *